US008058578B1

(12) United States Patent
Jordan et al.

(10) Patent No.: US 8,058,578 B1
(45) **Date of Patent: *Nov. 15, 2011**

(54) REMOTE SAFETY SWITCH

(75) Inventors: Michael C. Jordan, Knoxville, TN (US); David S. Jordan, Knoxville, TN (US)

(73) Assignee: Southwire Company, Carrollton, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/755,826

(22) Filed: Apr. 7, 2010

Related U.S. Application Data

(63) Continuation of application No. 11/534,571, filed on Sep. 22, 2006, now Pat. No. 7,723,630.

(60) Provisional application No. 60/720,120, filed on Sep. 23, 2005.

(51) Int. Cl.
*H01H 9/00* (2006.01)

(52) U.S. Cl. ..... 200/334; 200/51 R; 200/18; 361/189

(58) Field of Classification Search ..... 200/43.01, 200/43.02, 51 R, 51.02–51.05, 511, 51.12, 200/51 LM, 334, 86.5; 307/112–115, 139, 307/141, 141.8; 100/341–344; 192/116.5, 192/129 R, 130, 131 R, 131 H, 129 A; 361/189, 361/190; 700/311, 17, 20, 83–85, 168, 169
See application file for complete search history.

(56) References Cited

U.S. PATENT DOCUMENTS

| | | | | |
|---|---|---|---|---|
| 3,777,085 | A | 12/1973 | Horn | |
| 4,323,762 | A | 4/1982 | Ervin et al. | |
| 4,839,533 | A | 6/1989 | Aga | |
| 5,592,032 | A | 1/1997 | Keizer et al. | |
| 5,734,206 | A | 3/1998 | Keizer et al. | |
| 6,211,581 | B1 | 4/2001 | Farrant | |
| 6,392,169 | B1 | 5/2002 | Linger et al. | |
| 6,639,332 | B2 | 10/2003 | Metzler et al. | |
| 6,825,579 | B2 | 11/2004 | Ehrlich et al. | |
| 6,878,889 | B1 | 4/2005 | Horst et al. | |
| 6,969,811 | B1 | 11/2005 | Lai | |
| 7,184,258 | B2 | 2/2007 | Lai | |
| 7,422,432 | B2 | 9/2008 | Warner | |
| 7,470,277 | B2 | 12/2008 | Finlay et al. | |
| 7,723,630 | B1 * | 5/2010 | Jordan et al. | 200/334 |

OTHER PUBLICATIONS

U.S. Official Action dated May 13, 2009 in U.S. Appl. No. 11/534,571.
U.S. Notice of Allowance/Allowability dated Jan. 7, 2010 in U.S. Appl. No. 11/534,571.

* cited by examiner

*Primary Examiner* — Michael Friedhofer
(74) *Attorney, Agent, or Firm* — Hope Baldauff Hartman, LLC

(57) ABSTRACT

A safety switch allows for greater safety and greater ease in operating a machine where multiple operators may be required. The safety switch allows multiple operators in different locations to exercise control over the machine, reducing the risk of accidents and improper operation of the machine.

20 Claims, 11 Drawing Sheets

REMOTE SAFETY SWITCH

RELATED APPLICATIONS

This application is a continuation of and claims the benefit of U.S. patent application Ser. No. 11/534,571 now U.S. Pat. No. 7,723,630, filed on Sep. 22, 2006, and entitled "Remote Safety Switch," which claims the benefit of U.S. provisional patent application No. 60/720,120, filed on Sep. 23, 2005, and entitled "Remote Safety Foot Switch," both of which are expressly incorporated herein by reference in their entirety.

BACKGROUND OF THE INVENTION

1. The Field of the Invention

The present invention relates to a remote safety switch for use in operating machinery. More specifically, the present invention relates to a safety switch which provides greater safety in situations where two or more persons are working together in operating a machine by providing each operator a switch, such as a foot switch, which works in combination with the other operator's switch or switches to control the machinery. The safety switch allows for the operation of a machine which does not have a similar type of safety switch with the safety switch of the present invention.

2. State of the Art

Switches, such as foot switches are used to control pieces of machinery. A foot switch may be used to turn the machine on or off or activate one of the machine's functions. The foot switch typically turns the machine on or operates a particular function of the machine when stepped on or otherwise depressed, and causes the machine to cease operation when released.

Many machines do not have such foot switches or safety switches. Additionally, if a foot switch is available, it may not provide adequate safety in operating a machine or adequate control over the machine. Existing foot switches work in some situations where a single person operates a piece of machinery. Existing foot switches do not, however, work well with some types of machinery, or where two or more persons operate a single piece of machinery. In such a situation, only one person may stop the machinery if an undesired event or emergency occurs. In many situations, noise, lack of visual contact, or the like inhibit communication between operators and may create a dangerous situation. Where only one operator is in control of the machinery, that operator may be without knowledge of the other operator, and thus unable to stop the machine if a problem develops related to the other operator. If one operator notices a problem but does not have control over the machinery, they may be unable to quickly stop the machinery or communicate the problem to the other operator.

It is not uncommon to have multiple persons operating a piece of machinery. Multiple persons may be required to feed large pieces of material into a machine such as a saw or press. In such situations, the operators may often be in relatively close proximity. If an operator without control over the machinery notices a problem, they may be unable to quickly stop the machine or communicate the problem to the other operator so as to prevent damage or injury. Noise or other obstacles may inhibit communication between the operators.

In other situations, the operators may not be in close proximity, and may not be in visual contact. An example of this type of situation is where electricians are pulling wire through conduit for an electrical installation. Commonly, the wire is fed into the conduit in one location and pulled from the conduit in another location which may be in another room or another floor of a building.

While telephones or radios may be used to communicate, noise may prevent such communication, or the task being performed may prevent a person from using telephone or radio. Even if communication is possible, a person in control of the machine may simply not react quickly enough when a problem is communicated to them by the other machine operator so as to avoid an accident. It will be appreciated that where an operator communicates the existence of a problem over radio, telephone, or the like to another machine operator having a safety switch such as a foot switch, several seconds may pass before the operator having the foot switch realizes what is happening and stops the machine. The passage of several additional seconds may result in damage to the machine, improper execution of the task, or even injury to the machine operator.

There is thus a need for a device which allows multiple operators to each have control over a piece of machinery. There is need for a device which allows any of multiple operators to shut down a piece of machinery quickly if necessary. There is also need for a device which facilitates communication between multiple machine operators such that the machine may safely and properly be operated in an environment where noise or other impediments prevents communication between the machine operators.

SUMMARY OF THE INVENTION

It is an object of the present invention to provide a remote safety switch which allows any number of machine operators to have a switch capable of stopping the operation of a machine when necessary. It is an object of the present invention to utilize such a device to make operation of the machinery safer, especially in situations where communication between operators is impaired, or where quick reaction to a situation is necessary.

According to one aspect of the present invention, any machine may be operated with a safety switch. A universal safety switch is provided which may be used with any of a variety of different machines. The safety switch is typically provided with a power input and a power output, and a relay or equivalent which selectively provides power from the power input to the power output. The relay is controlled by the one or more switches, each controlled by an operator. Thus, virtually any existing machine may be controlled with the safety switch, of the present invention.

According to one aspect of the present invention, any of multiple operators may stop a machine in an emergency. Multiple operators may each be provided with a switch to thereby control the operation of the machine, often by controlling the starting/stopping of the machine when needed. According to another aspect of the invention, the device may operate so as to require each operator to depress their switch in order to operate the machine or perform a specific function. Thus, if any operator releases their switch the machine or function stops.

According to another aspect of the present invention, a machine operator may control the operation of a function of the machine without the use of their hands. Each operator may be provided with a foot switch which controls the operation of the machine. Thus, the invention provides an additional measure of safety and convenience in operating machines requiring the use of both hands.

According to another aspect of the present invention, each operator may be provided with signals which indicate the machine status or the status of the other operator or operators as may be required to operate a particular machine. Such signals may be inaudible signals such as lights so as to allow for safe and convenient operation of the machine in noisy environments or by persons who are hearing impaired.

According to another aspect of the present invention, the status of each operator may be displayed to the other operators by providing one or more indicators, typically a light such as an LED. The indicators may be illuminated when the other operators are depressing their foot switches, for example. Thus, if two persons are operating the machine, each person will be able to see an indicator demonstrating that the other person has depressed their foot switch and is ready for operation. Alternatively, each operator may be provided with two indicators corresponding to each other operator. Thus, an operator may see a red light when the other operator is not ready and a green light when the other operator has depressed the foot switch.

According to another aspect of the invention, a safety switch is provided which allows multiple persons to operate a machine even when not in close proximity to each other. Each of the operators may be provided with a portion of the safety switch, such as control module, each portion having a switch and having means for communicating with the other portions of the safety switch. Thus, each operator may have a control module having a switch wherein each of the control modules is in communication with the other control modules. The control modules may communicate via wireless technology, cables connecting the modules, or via existing electrical or communications cables. Communication may be accomplished by transmitting digital signals between the control modules via these and other communication paths.

According to another aspect of the present invention, a wireless remote foot switch may be provided. A first operator may have a master control module which has a foot switch, is connected to the machine, and which communicates wirelessly to a second remote module. A second operator may have a remote module which has a foot switch and which communicates wirelessly with the master control module. A wireless remote switch allows the use of the present invention in situations where distances or physical obstacles prevent wired communications between the machine operators.

These and other aspects of the present invention are realized in a remote safety foot switch as shown and described in the following figures and related description.

BRIEF DESCRIPTION OF THE DRAWINGS

Various embodiments of the present invention are shown and described in reference to the numbered drawings wherein.

It will be appreciated that the drawings are illustrative and not limiting of the scope of the invention which is defined by the appended claims. The various embodiments shown accomplish various aspects and objects of the invention. It will be appreciated that each of the drawings illustrates different aspects of the invention, and do not contain all aspects of the invention for clarity. The invention thus includes various aspects of any or all of the drawings.

DETAILED DESCRIPTION

The drawings will now be discussed in reference to the numerals provided therein so as to enable one skilled in the art to practice the present invention. The drawings and descriptions are exemplary of various aspects of the invention and are not intended to narrow the scope of the appended claims.

Figure 1:
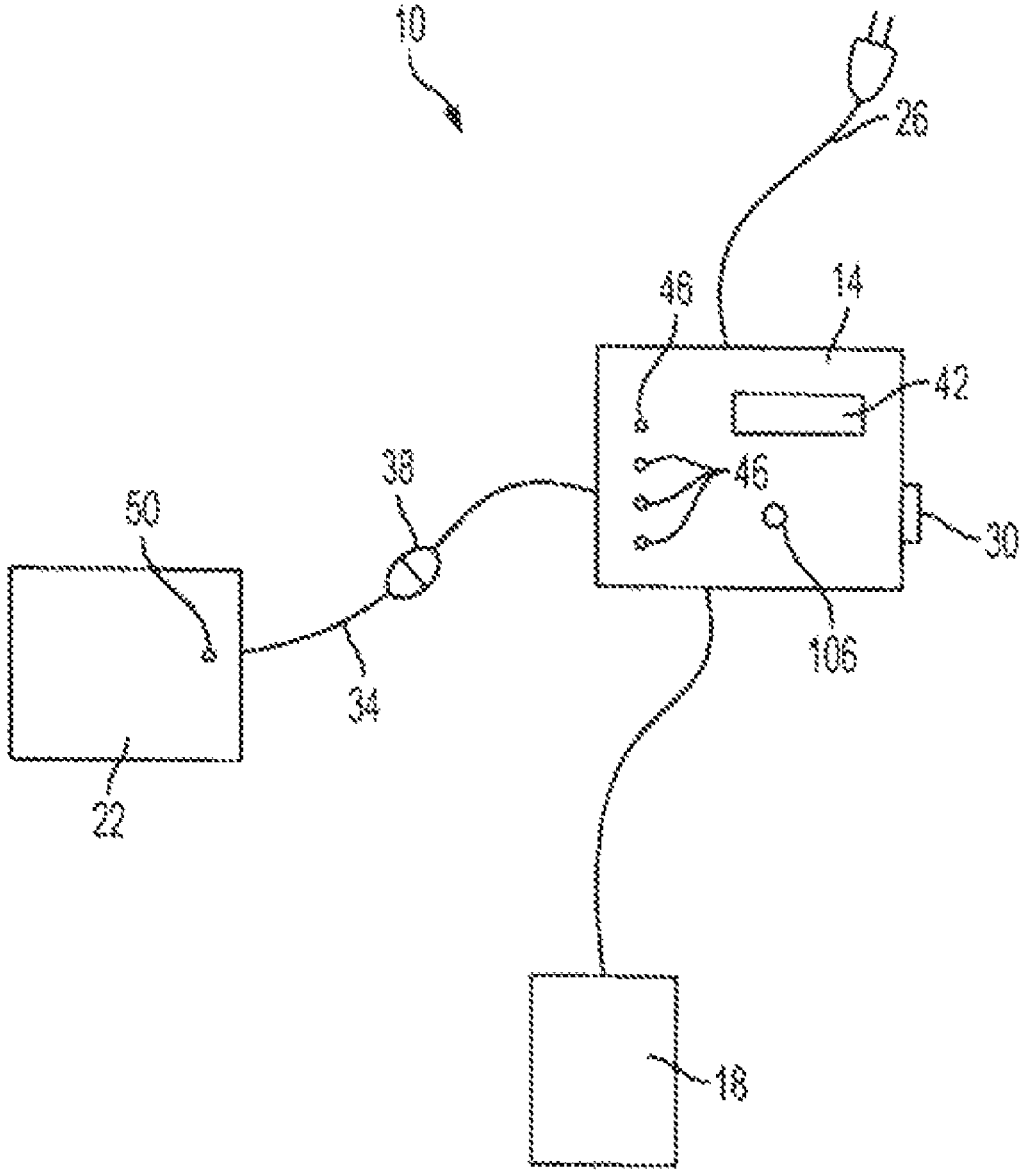
FIG. 1 shows a top view of a safety switch according to the present invention.

Turning to FIG. 1, a top view of a safety switch, indicated generally at 10, according to the present invention is shown. The safety switch 10 may include a master control module 14, main switch 18, and secondary switch 22. The main switch 18 and secondary switch 22 may be foot switches, hand switches, or other switches as may be appropriate for a desired use. It will be appreciated that, while the present invention often refers to foot switches, the invention applies more broadly to safety switches as are used to control or operate machinery. While the particular type of switch used is often a foot switch, in some circumstances it may be desirable to use a hand-held switch or other type of switch. For simplicity, the switches are often referred to as foot switches, and encompass the various types of switches which may be used.

It will be appreciated from the following discussion that the present invention provides a means whereby virtually any existing piece of machinery may be retrofitted with a safety switch. The present invention has particular relevance to machines which require multiple operators, such as where wires or utilities cables, pipes, etc. are being pulled through a conduit or other channel. In such a situation, one operator may be feeding wire into a conduit and another operator may be pulling wire from the conduit using a wire puller. Both operators benefit from control over the wire pulling machine and, if used, wire feeding machine. The machines should operate only when both operators are ready for operation. Distance, noise, etc., often prevent adequate communication between the operators.

According to a typical embodiment of the invention, all operators must activate a switch, such as a foot switch, in order for the safety switch to relay power to the wire pulling and feeding machines. Thus, the present invention allows the wire feeding and pulling machines to be operated via a safety switch which only operates the machines when both operators are ready. In such a manner, many machines may be fitted with a safety switch which provides greater control and safety in operating the machine. Without providing both operators with control over the machine, there is increased risk of injury or of damage to the machine or surrounding area.

It will be appreciated that the present invention provides for multiple operators of a single machine. Thus, the invention may comprise a master control switch and multiple secondary control switches, wherein each of the switches must be actuated to operate the machine. Thus, three, four, or more operators may each have a switch to thereby control the machine.

The master control module 14 will typically include a power cord 26 whereby the master control module is plugged into a source of electrical power, such as an A/C wall outlet. The master control module 14 will also typically have an output connector 30, and may include multiple output connectors, to which a machine (or machines, not shown) which is to be controlled by the foot switch is connected. The output connector 30 may alternatively be a cord having an appropriate connector for connection to a machine, such as a female electrical socket.

Typically, the power cord 26 is plugged into a power source which provides power to the safety switch and to the desired machine. A desired machine, such as a wire puller, saw, etc. is plugged into the output connector 30. Alternatively, the machine may be plugged into a convention power source such as a wall outlet for power and may be connected to the safety switch 10 such that the safety switch controls a particular function of the machine. The machine or the particular function of the machine is typically off unless both of the switches 18, 22 are activated (such as by depressing a foot switch). Switches 18, 22 are preferably foot switches for many applications of the present invention.

Switches 18, 22 may be removably attached to the master control module 14, allowing for easy transport. The cord 34 connecting the secondary switch 22 to the master control module 14 may also include a connector 38 which allows the cord to be lengthened for applications which require the operators to be farther apart. Additionally, the master control module 14 may include a switch 106 which allows a user to select whether a secondary switch 22 is used or whether the safety switch 10 will be used with only a main switch 18. It will be appreciated that in some circumstances an operator will be working alone, but may still appreciate other functions and benefits of the present invention.

The master control module 14 may also include a suitable display screen 42 such as an LCD display. The display screen 42 may be used for various operational purposes, including displaying the operational parameters of the machine connected to the safety switch 10. The display screen 42 may also be used to display status information related to other switches or machine operators. For example, if the safety switch 10 is used to control a wire puller, the display screen 42 may be used to display the force applied to the wire by the wire puller. To accomplish such a result, the master control module 14 would typically measure the electrical current drawn by the machine and convert the current value into a force reading based on machine data.

The master control module 14 may also have a plurality of indicator lights 46. The indicator lights may be used to indicate the operational status of the safety switch 10. The indicator lights 46 may indicate power supply to the control module, whether or not the machine is operating, whether or not each of the foot switches are depressed, whether the main switch 18 alone or in combination with the secondary switch 22 is controlling the machine, etc. The indicator lights 46 thus aid the machine operators in operating the machine. The secondary switch 22 may also have an indicator light 50 which is used to indicate whether or not the primary switch is depressed or otherwise activated. Indicator light 50 may not always be located on secondary switch 22, but it will be appreciated that it is typically desirable to provide a secondary machine operator with an indicator light 50 to display the status of the main operator.

The safety switch 10 may function by passing the primary electrical current through the switches 18, 22. Thus, at least one of the current carrying conductors of the power cord 26 is routed through the switches 18, 22 and to the output connector 30. Normally open switches may be used for switches 18, 22 such that a complete electrical circuit is not formed until both of the switches 18, 22 are closed by an operator. After both switches 18, 22 are closed, the machine operates. Such an arrangement is advantageous as it is a simple arrangement which allows the safety switch to function with a minimum of electrical components.

Alternatively, the switches 18, 22 may be connected to a relay such that the relay is activated to power a machine when both switches are depressed by the operators. Still yet, the master control module 14 may contain a processor (110, FIG. 3) which manages the operation of the machine. In such an arrangement, the foot switches would communicate with the processor. The processor would be in electrical connection with a relay which provides power to the machine. The processor would also control the functioning of the display screen 42, indicator lights 46, and would be largely responsible for the operation of the safety switch. Such an arrangement allows for a more sophisticated safety switch and is detailed in later figures. It will be appreciated in reading the present application that many features and modes of operation are shared by the devices shown in the various figures, which may vary simply by case design or layout and be similar in operation.

Figure 2:
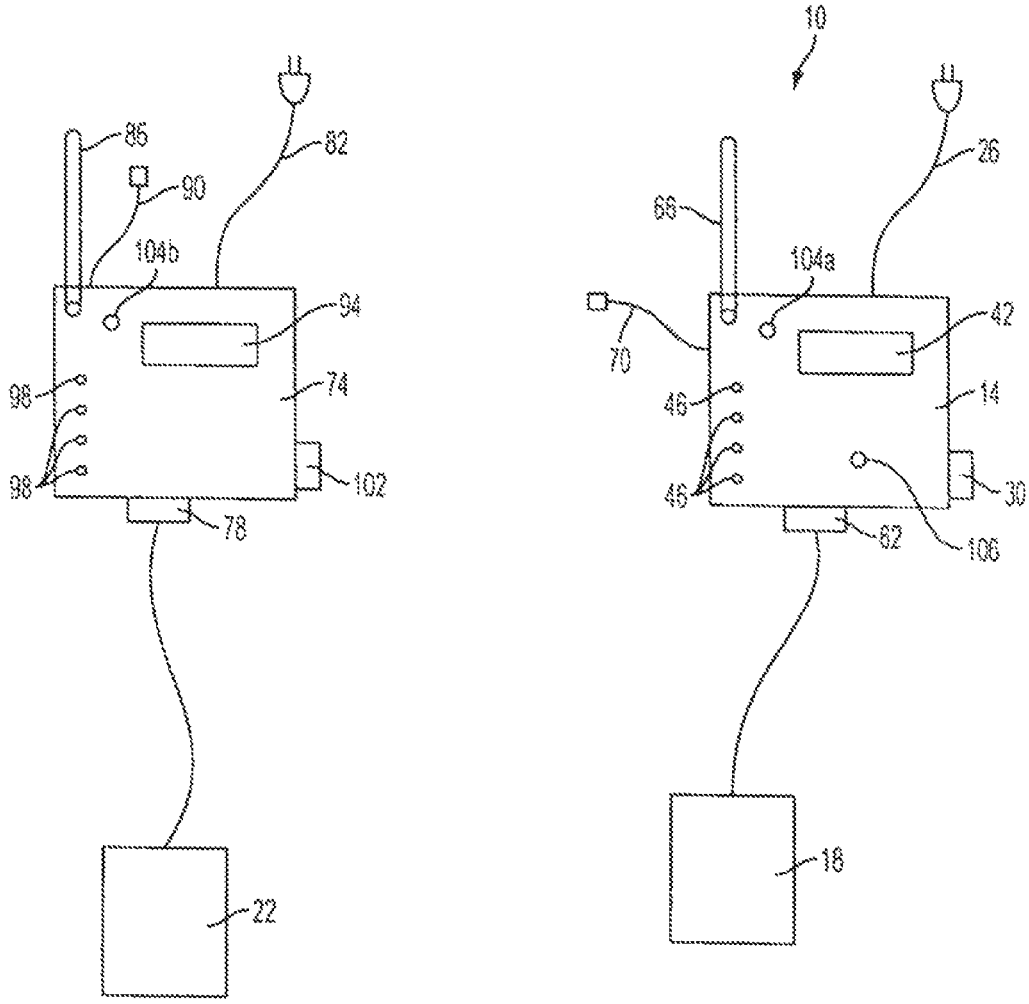
FIG. 2 shows another top view of a safety switch according to the present invention.

Turning now to FIG. 2, another top view of a safety switch according to the present invention is shown. The safety switch, indicated generally at 10, includes a master control module 14. The master control module 14 includes a main switch 18, power cord 26, output connector 30, display screen 42, and indicator lights 46 as previously discussed. The master control module 14 may also include a switch connector 62 whereby the main switch 18 may be removably connected to the master control module. The master control module may also include a communications antenna 66 and corresponding communications transceiver and/or a communications connector 70 whereby the master control module may communicate to a slave control module 74. The master control module 14 may also include a switch 106 whereby a user may select whether the safety switch operates with or without the slave control module, allowing a single operator to use the safety switch.

Although a single slave control module 74 is discussed, it will be appreciated that the safety switch may comprise multiple slave control modules. Each slave control module may communicate with the master control module so as to allow multiple operators to control the operation of the machine. If necessary, a master communications selection switch **104*a* and slave communications selection switch 104*b* may be provided whereby a user may select the mode or channel of communication for the master control module 14 and slave control module 74**.

The slave control module 74 includes secondary switch 22 as has been previously discussed. A switch connector 78 may be used to removably connect the secondary switch 22 to the slave control module 74. The slave control module 74 may include a power cord 82 whereby the slave control module may be connected to 110V AC power or another suitable power supply. Additionally, the slave control module 74 may include a battery (not shown), as the slave control module may not have a large power requirement for some applications, and as external power may not be available for some applications. The slave control module 74 may include a communications antenna 86 and corresponding communications transceiver and/or communications connector 90, configured for communicating with the master control module 14.

The slave control module may also include a display screen 94, indicator lights 98, and an output connector 102. According to some applications of the present invention, it may be desirable to power a machine from the slave control module 74. An example of such an application is wire pulling, where a wire puller may be connected to the output connector 30 of the main control module 14 and a wire feeder may be connected to the output connector 102 of the slave control module 74. Display screen 94 may be used to display operational parameters of the slave control module 74 of a machine plugged into output connector 102, the status of other machine operators, or may relay information regarding the machine to which the master control module 14 is connected.

Output connector 102 will typically function in a similar manner to output connector 30, meaning that output connector 102 will typically activate a machine plugged thereto when both the main switch 18 and the secondary switch 22 are both activated. Thus, both output connectors 30, 102 are typically activated at the same time. It is also possible to separately activate each output connector, such as by activating the slave output connector 102 when secondary switch 22 is activated, and by activating main output connector 30 when the main switch 18 and secondary switch 22 are activated.

It will be appreciated that, where multiple slave control modules 74 are used to provide control to multiple different operators, various modifications will be made to the master control module 14 and slave control modules 74. Such modifications may include the addition of indicator lights 46, 98 to allow each operator to know the status of all of the other operators, or the addition of communications control switches 104*a*, 104*b* so as to enable communication between the master control module 14 and slave control modules 74.

The master control module 14 may be configured to communicate with the slave control module 74 by a variety of means. The master control module 14 and slave control module 74 may communicate via communications antenna 66, 86 and corresponding communications transceivers. In such an arrangement, relevant signals are sent back and forth wirelessly between the master control module 14 and slave control module 74.

Alternatively, relevant signals may be transmitted via communications connectors 70, 90. Communications connectors 70, 90 may function in a variety of ways. For example, communications connectors 70, 90 may plug into existing telephone, internet, or networking connections available in a building and send the necessary signals over the available wires. Communications connectors 70, 90 may also be plugged into existing AC power lines and used to transmit a signal, such as a digital signal, over the power lines. It will also be appreciated that communications signals may be transmitted over AC power lines via power cords 26, 82. Communications connectors 70, 90 may also be plugged into a pair of cellular phones, 2-way radios, walkie talkies, or the like. Once communication is established between the pair (such as by establishing a telephone call between the phones), signals may be transmitted between the master control module 14 and slave control module 74. The communications connectors 70, 90 may connect to the headset/microphone connector of the telephones/radios. It will also be appreciated that, while more limited in range, communications connectors 70, 90 may be directly connected to each other. Those of skill in the art of communications will appreciate how to execute the above methods of communications.

Figure 3:
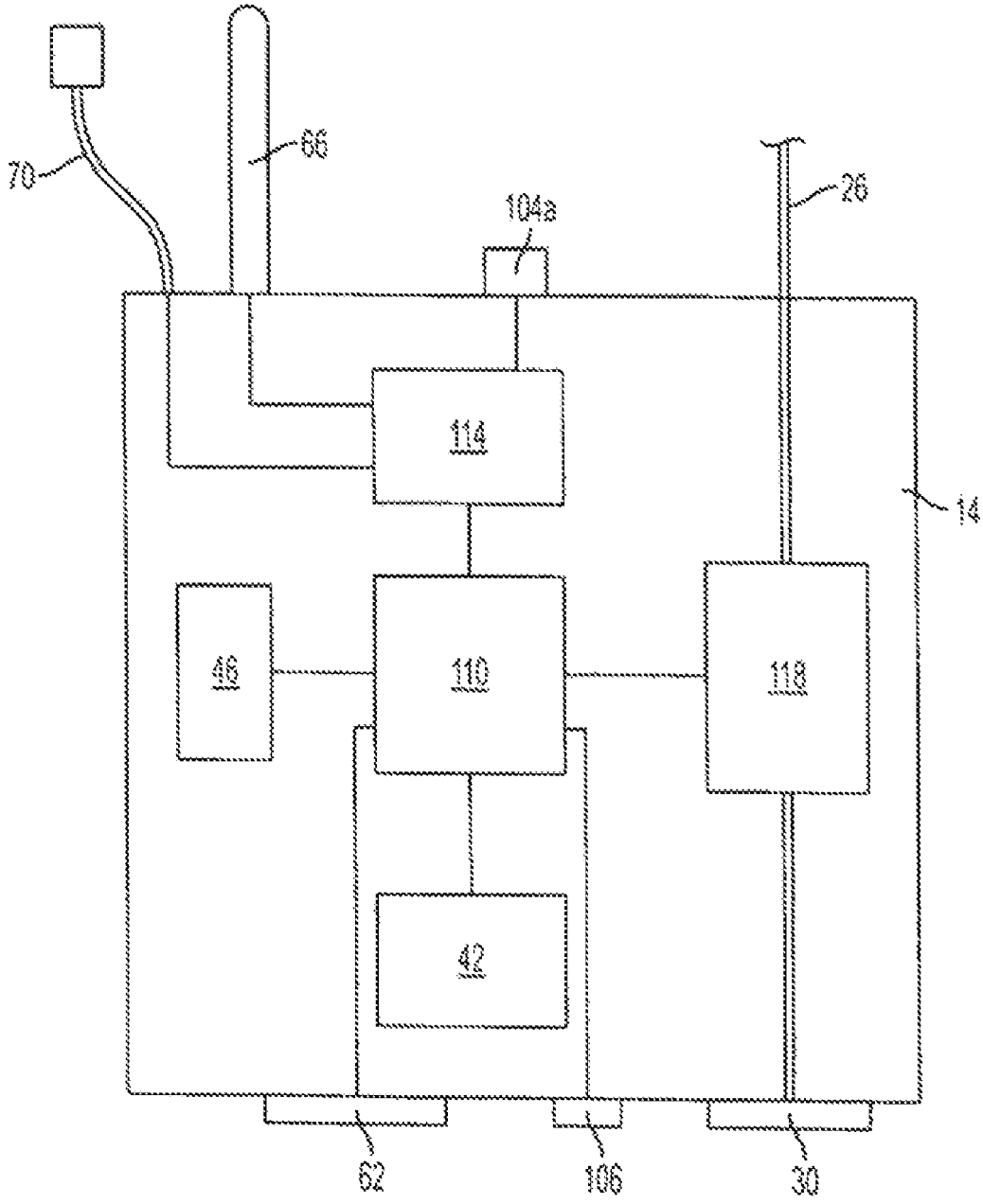
FIG. 3 shows a schematic diagram of a master control module according to the present invention.

Turning now to FIG. 3, a schematic diagram of a master control module 14 according to the present invention and as shown in FIG. 2 is shown. The master control module 14 typically includes a processor 110 responsible for governing the operation of the master control module. The processor 110 is in communication with communications antenna 66 and/or communications connector 70 via a transceiver 114 wherewith the master control module communicates with a slave control module. The transceiver 114 may be responsible for sending and receiving data from the master control module 14 and slave control module 74. For example, the transceiver 114 may convert operational status signals into digital signals which may be transmitted between control modules 14, 74. The master control module 14 may also be equipped with a communications selection switch 104*a* which may be used to select the method of communication or the channel or frequency of communication between the master control module 14 and a slave control module 74.

The processor 110 is also in communication with indicator lights 46, display screen 42, and switch connector 62 or main switch 18 (not shown). The controller 110 is also connected to a relay 118 whereby the controller 110 causes power to flow from power cord 26 to output connector 30.

In operation, the controller selectively illuminates indicator lights 46 according to the operation of the safety switch. (Those of skill in the art will appreciate that other signal generating means, such as sound, may also be used.) Thus, if power is provided to the master control module 14, a power light may be illuminated. One or more status lights may be illuminated to show the status of the secondary switch 22 (not shown) or slave control module 74 (not shown), such as illuminating a red light when the secondary switch is not activated and a green light when the secondary switch is activated. Another light may be activated when power is sent to a machine connected to output connector 30. Another light may be illuminated when communication exists between the master control module 14 and slave control module 74.

The display screen 42, as has been discussed, may be used to display the operational characteristics of the machine which is operated via the safety switch, or may be used to display operational characteristics of the master control module 14. Thus, if the safety switch is used to control a wire puller, the controller 110 may be calibrated so as to display the pulling force (as determined from current draw) of the wire puller. The processor 110 may be programmed with information for a number of different wire pullers so as to determine the pulling force used. Additionally, the controller 110 may be programmed to automatically determine the model of wire puller being used based on startup current, resistance, and/or other operating characteristics of the wire puller. The master control module 14 may be configured so as to allow a user to switch the display screen 42 to display current draw or other desired parameters.

The processor 110 may also be in communication with a switch 106 configured for selecting whether the master control module 14 functions alone, without a slave control module 74, or in combination with a slave control module 74. The master control module 14 may function with a slave control module 74, the modules controlling a wire puller and wire feeder for example, but may function alone in the sense of not requiring the switch 22 of the slave control module 74 to be depressed in order to operate the machinery. Such modes of operation will be discussed in greater detail later. In some applications, it will be desirable to have two or more machine operators, who may be in different locations. In such an application, the master control module 14 may be switched so as to function with at least one slave control module. In some applications, it may be necessary or desirable to have a single machine operator. The master control module 14 may then be switched (using switch 106) to function alone. It will be appreciated that the processor 110 may be programmed to automatically function alone if no slave control module is communicating with the master control module 14. For safety reasons, however, it may be desirable for the master control module 14 to cease functioning if configured for use with a slave control module and unable to communicate with the slave control module. Such an arrangement would prevent the machine from operating out of the control of a second operator when a communications signal is lost.

Figure 4:
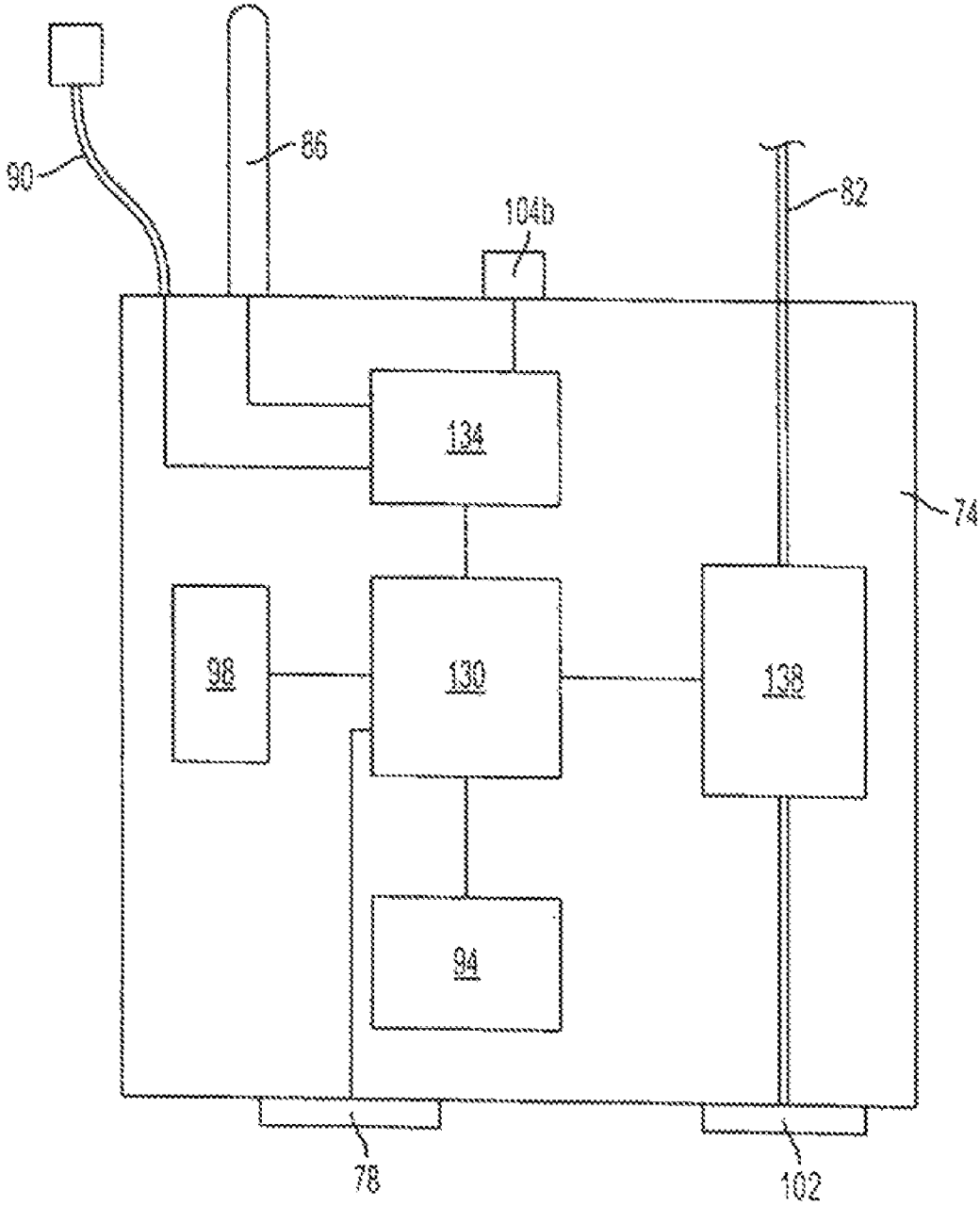
FIG. 4 shows a schematic diagram of a slave control module according to the present invention.

Turning now to FIG. 4, a schematic diagram of a slave control module 74 according to the present invention and according to FIG. 2 is shown. The slave control module 74 may function similar to the master control module 14 in many aspects as will be appreciated. Thus, when applicable, similar components of the slave control module 74 may function in the same way as the components of the master control module 14 discussed above. The slave control module 74 typically includes a processor 130, and a transceiver 134, and may include a relay 138. The secondary switch 22 (not shown) may be directly connected to the processor 130, or may be connected via switch connector 78.

In operation, the slave control module 74 communicates to the master control module 14 via transceiver 134 and communications antenna 86 or communications connector 90 as has been discussed above. The slave control module 74 may thus include communication selection switch 104*b* if necessary.

The processor 130 may be used to indicate the operational status of the safety switch via indicator lights 98, similar to that which has been discussed above. A light may be illuminated when the master control module 14 is on. Another light or lights may indicate the status of the main switch 18 (not shown), such as by illuminating a red light when the switch is not activated and a green light when the switch is activated. Another light may be used to indicate proper communication between the master control module 14 and slave control module 74. Another light may be used to indicate operation of the machine which is controlled via the safety switch.

Relay 138 may be used to provide power from power cord 82 to output connector 102. As has been mentioned, it may be desirable to operate two machines from the safety switch, such as operating a wire feeder from the slave control module 74 while operating a wire puller from the master control module 14. As has been discussed, it may be desirable to operate any machine plugged into output connector 102 simultaneously with any machine plugged into output connector 30 of master control module 14. If such is the case, the processor 130 will send power to output connector 102 via relay 138 when the main switch 18 and secondary switch 22 (not shown) are both activated. For some situations, it may be desirable to begin operation of one machine before the other machine. In such a situation, the machine plugged into the output connector 102 of the slave control module 74 may begin operation when the secondary switch 22 is activated, and the machine plugged into the output connector 30 of the master control module 14 begins operation when the main switch 18 and secondary switch 22 are both activated.

The display screen 94 may be used to display the operational characteristics of a machine which is connected to output connector 102 by displaying the power used, force applied, etc. The processor 130 may be programmed to function with machines which are anticipated to be used commonly with the safety switch. Such a machine might include a wire feeder or cable feeder as may be used in combination with a wire or cable puller in electrical installations or installing utility lines, such as pipe, electrical lines, gas lines, communications lines, etc. The processor 130 may be programmed to recognize a machine plugged into the output receptacle 102 based on resistance, startup current, etc. and may thus automatically provide the force applied by the machine, or another desired characteristic based on machine current draw.

Figure 5:
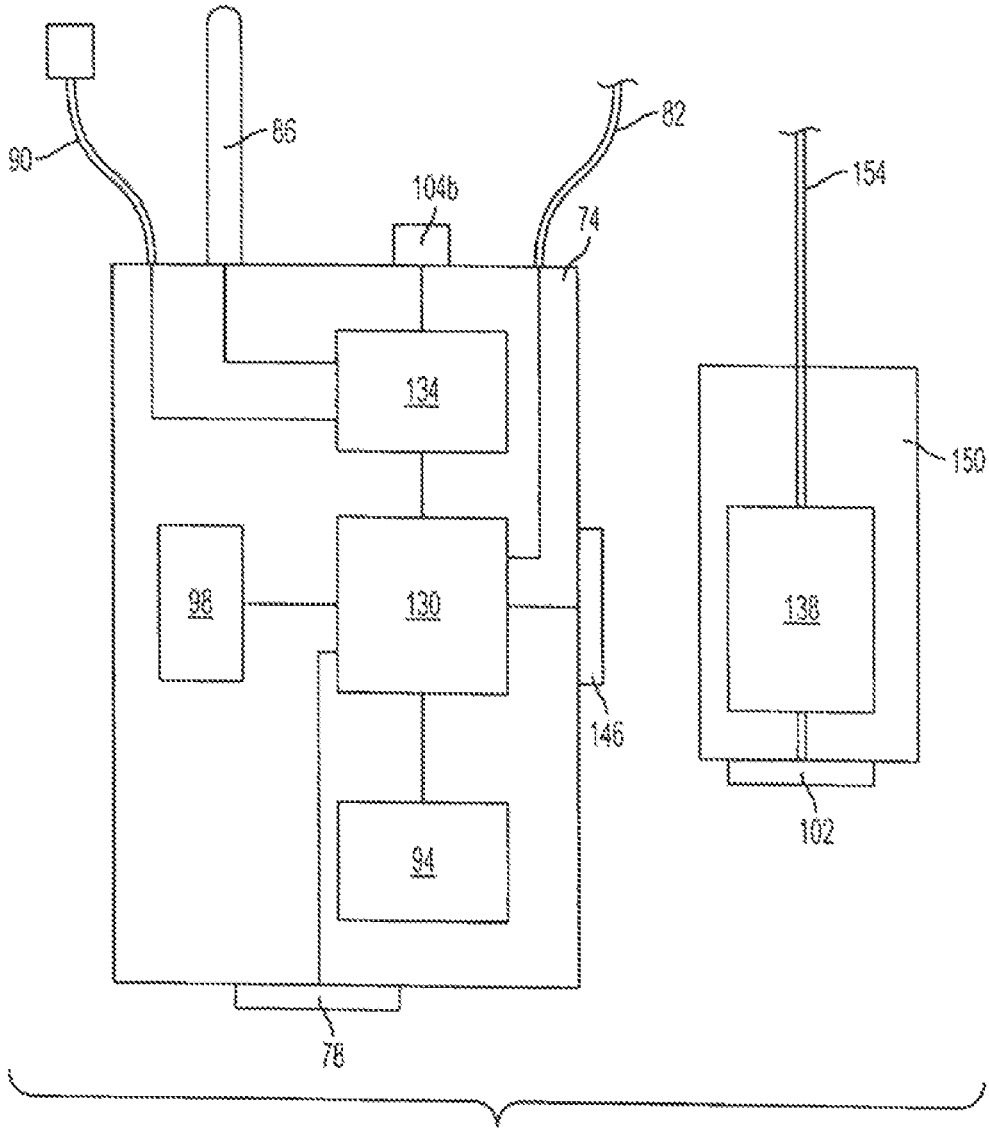
FIG. 5 shows another schematic diagram of a slave control module according to the present invention.

It will also be appreciated that the relay 138 and output connector 102 may be formed separate from the slave control module 74 and attachable to the slave control module as is needed. Turning to FIG. 5, a schematic diagram of a slave control module 74 having a removable output connection is shown. In such a configuration, the slave control module 74 would typically contain a processor 130, transceiver 134, indicator lights 98, display screen 94, communications antenna 86 and/or communications connector 90, communications selector switch 104*b*, power cord 82, and switch connector 78 as discussed above. The slave control module 74 may also contain a relay connector 146 to allow connection of relay module 150 to the slave control module, and for facilitating communication between the slave control module and the relay module. The relay module 150 contains the relay 138 and output connector 102, and may contain a power cord 154 for providing power to the relay 138 then subsequently to the output connector 102 and machine. Alternatively, power may be supplied from the slave control module 74 and provided via relay connector 146. The slave control module and relay module would function substantially as described in reference to FIG. 4.

It will be appreciated that the precise electrical components used to configure the master control module 14 and slave control module 74 may vary from that discussed and achieve the same functionality. For example, the processors and control components may be replaced with simple switches and relays.

Figure 6:
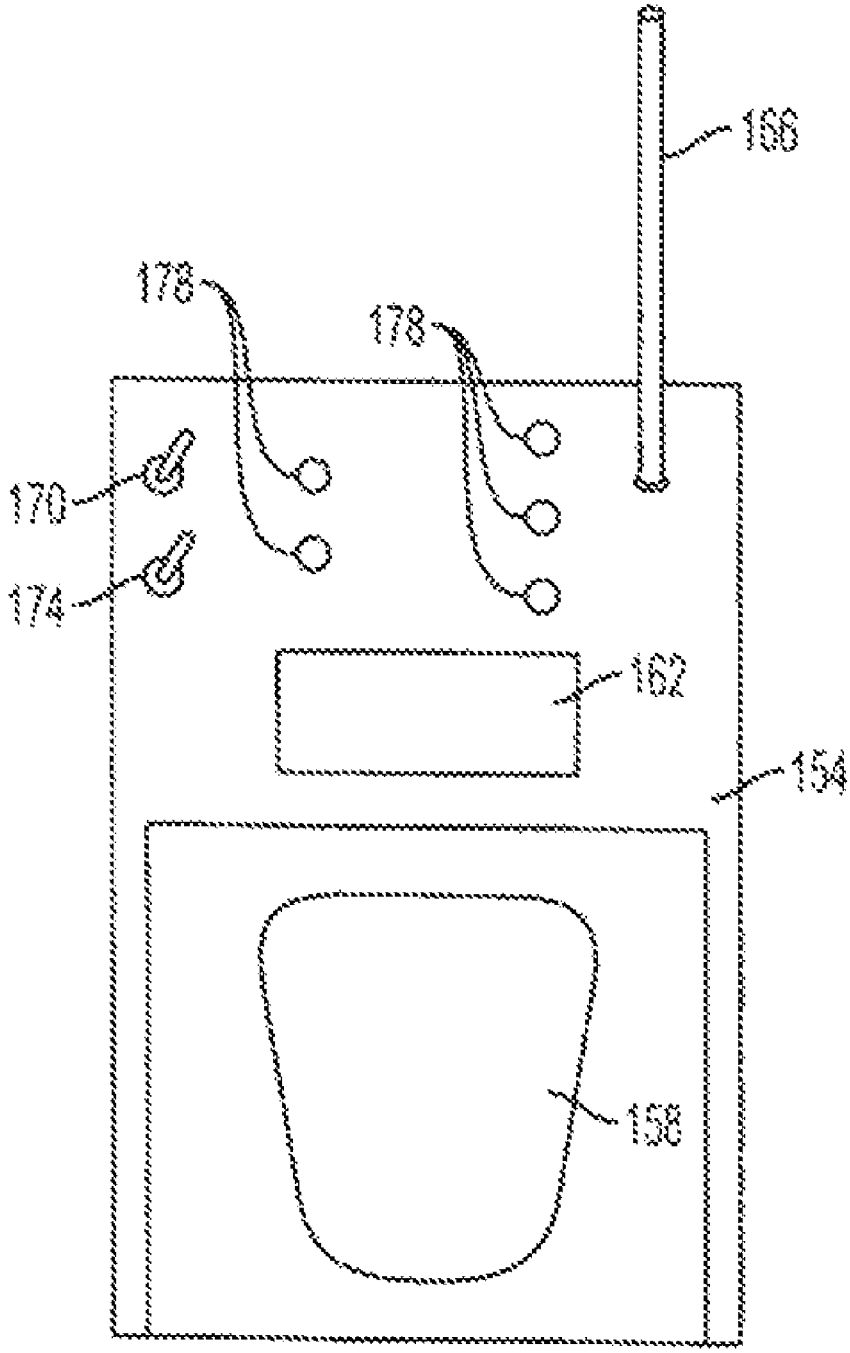
FIG. 6 shows a top view of a control module according to the present invention.

Turning now to FIG. 6 a top view of an alternate construction of the safety switch as previously shown. The control module 154 is similar to those previously shown and functions in accordance with the previous discussion. The control module 154 may function as either a master or slave control module, or may be configured as a dedicated master or slave control module. The control module 154 has a switch 158 which is attached to the body of the control module 154. As such, the switch 158 is particularly useful as a foot switch. The control module 154 also has a display screen 162 and communications antenna 166 or other communications device as has been discussed. The control module 154 includes a power switch 170 which may be used to turn the module on or off, and a mode switch 174 which may be used to select the mode of operation. If the control module 154 is a slave control module, the power switch 170 may also include a charging position, allowing for recharging of an internal battery used to allow for operation without outside power. If the control module 154 is a slave control module, the mode switch 174 may or may not be included. If included, the mode switch 174 may be used to switch the slave module 154 between a mode where the switch 158 must be depressed to operate a machine connected to the control modules, and a mode where the switch need not be depressed to operate the machine. The various modes of operation are as has been discussed, and will be discussed additionally hereafter.

The control module 154 also includes various indicator lights 178. Indicator lights 178 may include a light for indicating whether the control module 154 is on or off, whether other control modules are in range, whether the operated machines are stopped (whether other operators are not ready and have not depressed their control switch), when the other operators are ready and have depressed their control switch, and whether the machine is running. Of significant benefit is the ability to know the status of the other operators. Thus, it is typically desirable to have an indicator light 178 which is illuminated when remote operators have depressed their safety switch, indicating to the remaining operators that the machine is ready to operate.

Figure 7:
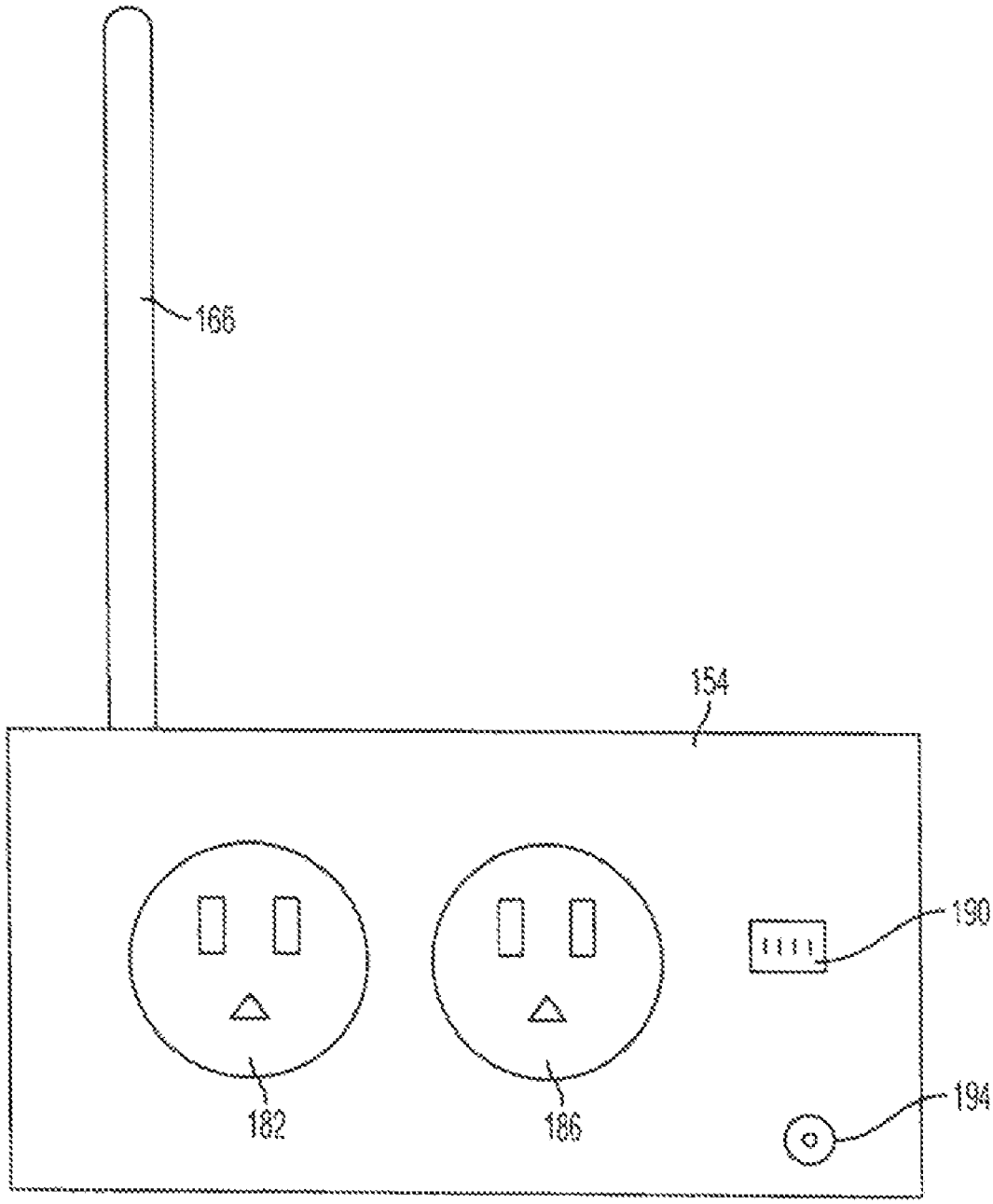
FIG. 7 shows a back view of the control module of FIG. 6.

Turning now to FIG. 7, a back view of the control module 154 of FIG. 6 is shown. The control module 154 includes a socket 182 into which a machine may be plugged and a plug 186 for providing power to the control module 154 and to the machine. The plug 186 may be a plug formed in the case of the control module 154 as shown, or may be a cord and plug extending from the control module 154 as previously shown. The control module 154 may contain multiple sockets 182, allowing multiple machines to be controlled simultaneously from the same control module. An additional connection port 190 may be included, and may be used for a communications port as discussed previously. Alternatively a port 190 may be included and used to connect an additional sensor to the control module 154. The use of such a sensor will be discussed hereafter. The control module 154 may also have a charge port 194 used to recharge a battery, if included. It is appreciated that both master and slave control modules may include the various plugs and connectors as shown.

In discussing the control modules above, the communication between the control modules is discussed as two-way communication. As such, each control module may receive and display information regarding the other modules, such as if the operator has depressed the switch or not. It is possible, though slightly less desirable, to use only one-way communication between the control modules. In such a configuration the slave control modules would transmit information to the master control module, allowing the primary operator to know when the secondary operators are ready. In such an arrangement, the operators may decide on rules of operation to avoid accidents. For example, it may be decided that the secondary operator always depresses the switch first and that the primary operator wait a short period of time before depressing his switch and starting the machines. Such an arrangement will ensure that the machine does not start immediately when the secondary operator depresses his switch. Such is advantageous as the secondary operator may not know the status of the primary operator where one-way communication is used.

Figure 8:
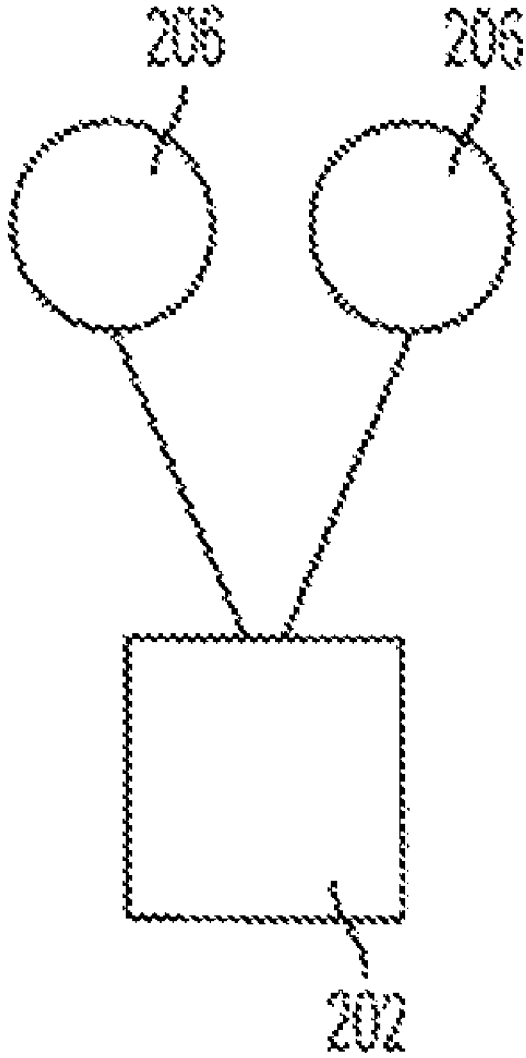
FIG. 8 shows a schematic diagram of a method of using the present invention.

Turning now to FIG. 8, a schematic diagram of a method of using the control modules of the present invention is shown. In discussing this and the following diagrams, it is appreciated that the safety switch modules may be any of those discussed previously. In the following figures, a safety switch module, such as a master control module or a slave control module is represented by a square. A master or slave control module which does not require operator input is represented by a hexagon. A machine which is controlled by the control modules is represented by a circle. Sensors or other equipment are represented by triangles. Communication between control modules is represented by dashed lines. For simplicity, machines and sensors are shown in the combinations which are particularly suited to certain methods of operation. It will be appreciated that additional control modules, sensors, or machines may be connected to any of the following figures according to the principles discussed herein.

FIG. 8 shows a single control module 202 which is connected to one or more machines 206. The machines are connected to the control module 202 as previously discussed, such that the machine operates when the switch associated with the module is depressed by an operator. Thus, the control module 202 is used to provide an emergency shutoff for the machines, and may provide increased control over the machines by allowing an operator to start and stop the machines with his foot, leaving his hands free for working.

Figure 9:
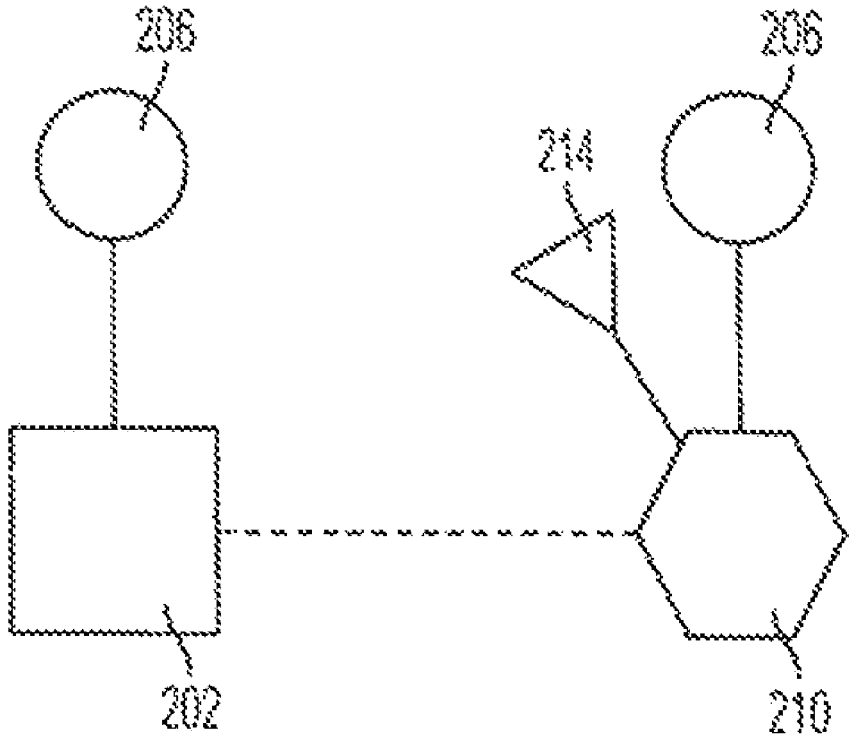
FIG. 9 shows a schematic diagram of a method of using the present invention.

FIG. 9 shows another schematic diagram of a method of using the control modules of the present invention. A master control module 202 is in communication with a slave control module 210, and being operated in a standalone mode where operator input is not required at the slave control module 210. Both the master control module 202 and slave control module 210 are connected to machines 206. The slave control module 210 is also connected to a sensor 214. The master control module 202 could also be connected to a sensor if desired.

Such an arrangement is advantageous where a single operator must control an operation requiring two machines, such as a wire puller and a wire feeder. In such a configuration, the slave control module 210 does not require input, such as a person depressing the foot switch, but will switch the machine 206 on and off in accordance with the operator in put at the master control module 202. The sensor 214 may be used to sense the occurrence of an event, such as the wire exiting the conduit, or any other desired event. As such the sensor 214 could be one of many types, such as an optical sensor, impact sensor, contact switch, etc. Upon detection of the desired event, the sensor could stop the machines, or could send a signal to the master control module, such as by illuminating an indicator light. In such an arrangement, it may be desirable that a switch on the slave control module 210 functions as an emergency shutoff in case of emergency, but not require an operator hold the switch in a position for normal operation.

Figure 10:
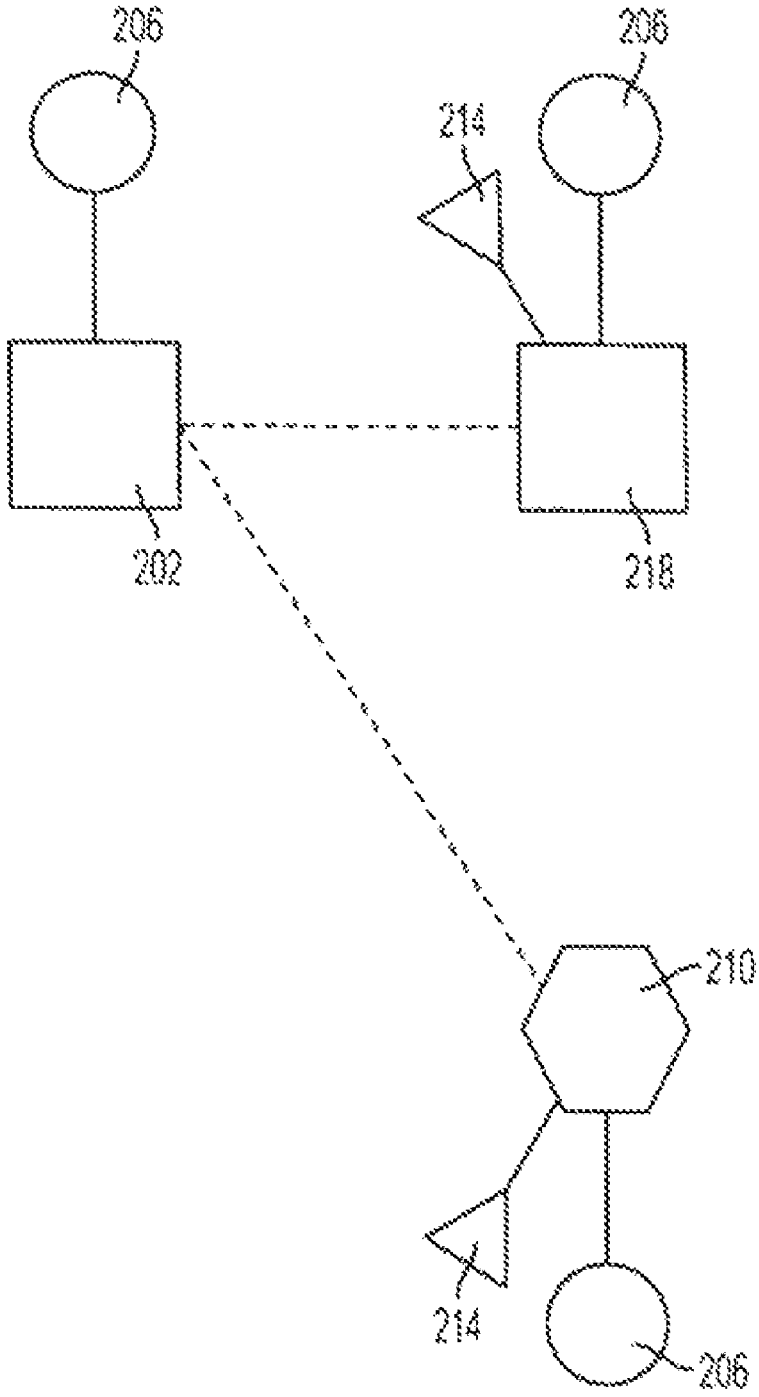
FIG. 10 shows a schematic diagram of a method of using the present invention.

FIG. 10 shows a method of operation similar to that of FIG. 9, including a master control module 202 which is in communication with a slave control module 210 not requiring an operator and a slave control module 218 which requires an operator input for operation of the machines 206 connected to the control modules 202, 210, 218.

Figure 11:
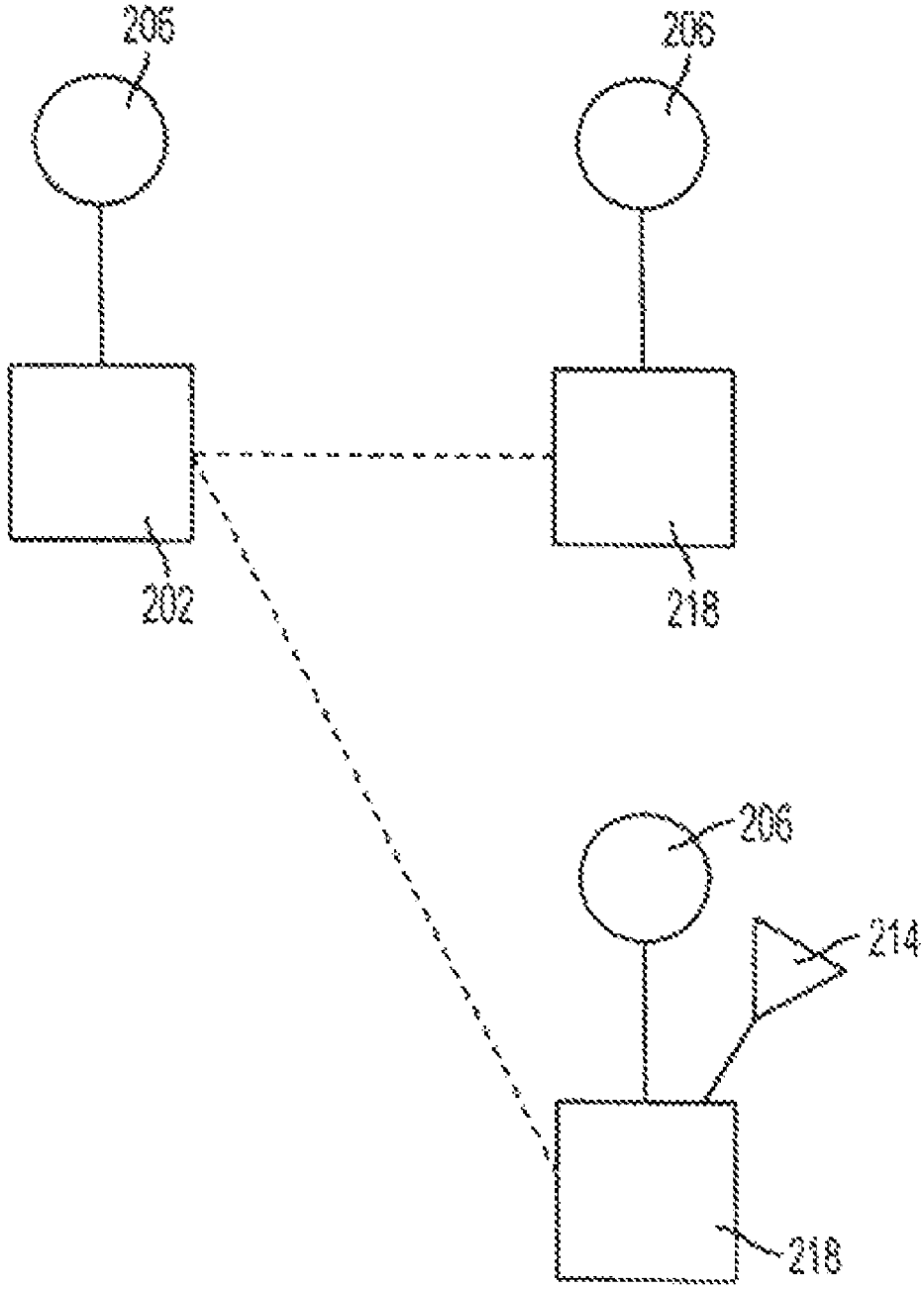
FIG. 11 shows a schematic diagram of a method of using the present invention.

FIG. 11 shows another schematic diagram of a method of operating the control modules of the present invention. A master control module 202 is in communication with one or more slave control modules 218. Any or all of the control modules may be connected to one or more machines 206 or sensors 214. The system as shown requires operators at each control module 202, 218 in order to operate the machines 206.

There is thus disclosed an improved safety switch. It will be appreciated that numerous changes may be made to the present invention without departing from the scope or spirit of the invention.

What is claimed is:

1. A method for controlling a machine, the method comprising:

receiving a connection of the machine at a master control module, the master control module configured for selectively providing power to the machine;

receiving a connection of a main switch and a secondary switch at the master control module, wherein the main switch and the secondary switch are in different locations;

selectively providing power to the machine when both the main switch and the secondary switch are actuated; and selecting whether actuation of both the main switch and the secondary switch provide power to the machine or whether actuation of only the main switch provides power to the machine.

2. The method of claim 1, further comprising displaying operational parameters of the machine at the master control module.

3. The method of claim 2, wherein the machine comprises a wire puller and wherein the operational parameters comprise a force applied to a wire by the wire puller.

4. The method of claim 1, further comprising providing an indicator at the master control module to show at least one of whether the machine is operating, whether the main switch and the secondary switch are actuated, or whether actuation of the main switch only provides power to the machine.

5. The method of claim 1, further comprising providing an indicator at the secondary switch to show whether the main switch is actuated.

6. The method of claim 1, wherein the master switch and the second switch are momentary contact switches.

7. A method for controlling a first machine, the method comprising:

receiving a connection of the first machine at a master control module, the master control module configured for selectively providing power to the first machine;

receiving a connection of a main switch at the master control module;

receiving a connection of a secondary switch at a slave control module in communication with the master control module, wherein the master control module and the slave control module are in different locations;

selectively providing power to the first machine when both the main switch and the secondary switch are actuated; and selecting whether actuation of both the main switch and the secondary switch provide power to the first machine or whether actuation of only the main switch provides power to the first machine.

8. The method of claim 7, further comprising:

receiving a connection of a second machine at the slave control module; and selectively providing power to the second machine when both the main switch and the secondary switch are actuated.

9. The method of claim 8, further comprising:

providing a sensor at the slave control module; and when the sensor detects an occurrence of an event, ceasing power to the first machine and the second machine.

10. The method of claim 9, wherein the first machine is a wire puller, the second machine is a wire feeder, and the occurrence of the event is a wire exiting a conduit.

11. The method of claim 8, further comprising displaying operational parameters of the second machine at the slave control module.

12. The method of claim 8, further comprising:

providing a sensor at the slave control module; and when the sensor detects an occurrence of an event, providing an indication at the master control module.

13. The method of claim 7, further comprising:

receiving a connection of a second machine at the slave control module;

providing power to the second machine when only the secondary switch is actuated; and providing power to the first machine and the second machine when both the main switch and the secondary switch are actuated.

14. The method of claim 7, wherein the master control module and the slave control module communicate wirelessly.

15. The method of claim 7, further comprising providing an indicator at the master control module to show at least one of whether the first machine is operating, whether the main switch and the secondary switch are actuated, or whether actuation of the main switch only provides power to the machine.

16. The method of claim 7, further comprising providing an indicator at the slave control module to show whether the main switch is actuated.

17. The method of claim 7, further comprising ceasing power to the first machine when the master control module is unable to communicate with the slave control module.

18. The method of claim 7, further comprising displaying operational parameters of the first machine at the master control module.

19. The method of claim 18, wherein the first machine comprises a wire puller and wherein the operational parameters comprise a force applied to a wire by the wire puller.

20. The method of claim 7, wherein the master switch and the second switch are momentary contact switches.

* * * * *